US006626648B1

(12) United States Patent
Kim

(10) Patent No.: US 6,626,648 B1
(45) Date of Patent: Sep. 30, 2003

(54) APPARATUS FOR NOISE DEPRECIATING IN HERMETIC COMPRESSOR

(75) Inventor: Tae-Min Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/622,784

(22) PCT Filed: Dec. 29, 1999

(86) PCT No.: PCT/KR99/00832

§ 371 (c)(1),
(2), (4) Date: Aug. 23, 2000

(87) PCT Pub. No.: WO00/40861

PCT Pub. Date: Jul. 13, 2000

(30) Foreign Application Priority Data

Dec. 31, 1998 (KR) ..... U1998-28344 U

(51) Int. Cl.[7] ..... F04B 39/00; F04B 53/00

(52) U.S. Cl. ..... 417/312; 181/229; 181/230; 181/403

(58) Field of Search ..... 417/312; 181/229, 181/230, 403

(56) References Cited

U.S. PATENT DOCUMENTS

| | | | | | |
|---|---|---|---|---|---|
| 4,582,468 | A | * | 4/1986 | Bar | 417/312 |
| 5,496,156 | A | * | 3/1996 | Harper et al. | 417/312 |
| 5,577,898 | A | * | 11/1996 | Lee | 417/312 |
| 5,584,674 | A | * | 12/1996 | Mo | 417/312 |
| 5,888,055 | A | * | 3/1999 | Lee | 417/312 |
| 5,938,411 | A | * | 8/1999 | Seo | 417/312 |
| 5,971,720 | A | * | 10/1999 | Fagotti et al. | 417/312 |
| 6,129,522 | A | * | 10/2000 | Seo | 417/312 |
| 6,149,402 | A | * | 11/2000 | Kim | 417/312 |
| 6,358,019 | B1 | * | 3/2002 | Iversen et al. | 417/312 |

FOREIGN PATENT DOCUMENTS

| | | |
|---|---|---|
| JP | 61-179379 | 11/1986 |
| JP | 7-174072 | 7/1995 |
| KR | 87-8543 | 6/1987 |

* cited by examiner

*Primary Examiner*—Charles G. Freay
*Assistant Examiner*—William H. Rodriguez
(74) *Attorney, Agent, or Firm*—Fleshner & Kim, LLP

(57) ABSTRACT

The object of the invention is to provide an apparatus for noise depreciating in hermetic compressors. In the apparatus for noise depreciating for hermetic compressors of this invention, a diaphragm (45) is mounted to the interior surface of a chamber cover (40) through a welding process, thus dividing the interior of a muffling unit (30) into two chambers (31 and 31'). In a process of producing the above device, the chamber cover (40), integrated with the diaphragm (45), is locked to the top of a frame (2) having the chamber (31), with a packing (35) being interposed along the junction between the cover (40) and the frame (2). In the device of this invention, an inclined part (47) is formed along the edge of the diaphragm (45), thus allowing the diaphragm (45) to be easily and firmly integrated with the chamber cover (40) into a single structure by a welded material C during a process of welding the diaphragm (45) to the chamber cover (40). The apparatus of this invention remarkably improves work efficiency and productivity while assembling and forming such apparatus for noise depreciating in hermetic compressors.

17 Claims, 6 Drawing Sheets

APPARATUS FOR NOISE DEPRECIATING IN HERMETIC COMPRESSOR

TECHNICAL FIELD

The present invention relates, in general, to hermetic compressors and, more particularly, to an apparatus for depreciating a noise of highly compressed working fluid in such hermetic compressors.

BACKGROUND ART

FIG. 1 shows the internal construction of a conventional hermetic compressor having a connecting rod.

As shown in the drawing, the conventional hermetic compressor comprises a hermetic housing 1 consisting of upper and lower casings 1*t* and 1*b*, with a sealed cavity being formed within the housing 1 and a frame 2 being set within the sealed cavity of the housing 1. A stator 3 is fixedly mounted to the frame 2 and electromagnetically rotates a rotor 4 integrated with a crankshaft 5, thus finally rotating the crankshaft 5. The construction of the rotor 4 will be described in detail later herein. The above frame 2 is held in the hermetic housing 1 by a spring 2S.

The crankshaft 5 is installed within the hermetic housing 1 while passing through the central portion of the frame 2, while the rotor 4 is integrated with the crankshaft 5 into a single structure. The above rotor 4 is electromagnetically rotated along with the crankshaft 5 in cooperation with the stator 3.

An eccentric pin 5*b* is provided on the upper end of the crankshaft 5 while being eccentric from the rotating axis of the crankshaft 5. A balance weight 5*c* is provided on the crankshaft 5 at a position opposite to the eccentric pin 5*b*. Provided on the lower end of the crankshaft 5 is a pump 5*d*, which generates pumping force for sucking lubrication oil L from the bottom of the lower casing 1*b* of the housing 1 to an oil passage 5*a* of the crankshaft 5.

On the other hand, a cylinder 6, having a compression chamber 6', is integrated with the frame 2 into a single structure, with a piston 7 being set in the compression chamber 6' of the cylinder 6. The above piston 7 is connected to the eccentric pin 5*b* of the crankshaft 5 through a connecting rod 8. In such a case, the eccentric pin 5*b* of the crankshaft 5 is connected to a crankshaft connection part 8*a* of the connecting rod 8, while the piston 7 is connected to a piston connection part 8*b* of the connecting rod 8 through a piston pin 7'.

A valve assembly 9 is installed on the end of the cylinder 6. This valve assembly 9 controls a flowing of working fluid, or refrigerant, which is sucked into and exhausted from the compression chamber 6' of the cylinder 6. A head cover 10 is mounted to the valve assembly 9 so as to form an exhaust chamber 10' (see FIG. 3), through which the working fluid passes after being exhausted from the compression chamber 6'. In the drawing, the reference numeral 12 denotes a suction pipe used for sucking the working fluid into the hermetic housing 1, and the reference numeral 13 denotes an exhaust pipe used for discharging the compressed working fluid from the compressor into the outside of the compressor.

In the above compressor, a suction muffler 11 is installed within the hermetic housing 1 while communicating with the compression chamber 6' of the cylinder 6 through the valve assembly 9. The above suction member 11 is used for educing operational noises of the working fluid.

The above compressor also has a device for muffling exhaust operational noises of compressed and exhausted working fluid during an operation of the compressors. The construction of this muffling device is shown in FIGS. 2 to 4. As shown in the drawings, a fluid exhaust passage 14 is formed in the compressor while passing through the cylinder 6 and communicates with the exhaust chamber 10' formed by the head cover 10. A muffling unit 16 is formed on the frame 2 and receives the working fluid flowing from the exhaust passage 14. A chamber cover 17 is mounted to the frame 2, thus defining a muffling chamber 16' of the muffling unit 16. The exhaust operational noises of the compressed working fluid is practically reduced within the muffling chamber 16'. A loop pipe 18 is installed on the muffling unit 16 while passing through the chamber cover 17.

In the above muffling unit 16, the chamber cover 17 is locked to the frame 2 by a locking bolt 19, thus forming the desired muffling chamber 16' of the muffling unit 16. The above locking bolt 19 is tightened to the locking boss 16*b* formed on the frame 2. A diaphragm 21 is installed within the muffling chamber 16' of the muffling unit 16 so as to divide the muffling chamber 16' into two parts. The object of such a division of the muffling chamber 16' by the diaphragm 21 is to improve the noise-muffling effect of the muffling unit 16.

The above diaphragm 21 has a hole 22 at its center, thus allowing the two parts of the muffling chamber 16' to communicate with each other through the hole 22. The above hole 22 also allows the locking bolt 19 to pass through prior to being tightened to the locking boss 16*b* of the frame 2. The diaphragm 21 is thus locked to the frame 2 along with the chamber cover 17 by the locking bolt 19.

In order to prevent a leakage of working fluid from the muffling chamber 16' of the unit 16, two packing rings 20 and 20' are closely interposed between the frame 2, the chamber cover 17 and the upper and lower surfaces of the edge of the diaphragm 21 as best seen in FIG. 4. A sealing washer 19' is fitted over the shank of the locking bolt 19, thus being closely positioned at the junction between the bolt head and the top center of the chamber cover 17 and sealing the junction when the bolt 19 is fully tightened to the locking boss 16*b* of the frame 2 along with the chamber cover 17.

In an operation of the above hermetic compressor, compressed working fluid is discharged from the compression chamber 6' of the cylinder 6 as follows. That is, the working fluid, compressed by the piston 7 within the compression chamber 6', is discharged from the chamber 6' into the exhaust chamber 10', formed by the head cover 10, through the valve assembly 9, used as an exhaust valve.

The compressed working fluid is, thereafter, fed to the muffling chamber 16' through the fluid exhaust passage 14 formed in the cylinder 6. In the muffling chamber 16', the working fluid orderly passes through the two parts of the chamber 16', thus being reduced in pulse of pressure wave prior to being discharged from the muffling chamber 16' into the outside of the hermetic housing 1 through the loop pipe 18.

However, the conventional apparatus for noise depreciating of compressed working fluid in a hermetic compressor is problematic as follows due to the fact that it is somewhat difficult to lock both the chamber cover 17 and the diaphragm 21 to the locking boss of the frame using the locking bolt 19, thus reducing work efficiency while forming a desired apparatus for depreciating noises in the compressor.

That is, in order to mount both the chamber cover 17 and the diaphragm 21 to the frame 2, the first packing ring 20' is laid on the frame 2 at a position around the muffling unit 16 prior to laying the diaphragm 21 on the packing ring 20'. Thereafter, the second packing ring 20 is laid on the edge of the diaphragm 21 prior to laying the chamber cover 17 on said packing ring 20. The chamber cover 17 is, thereafter, fully locked to the locking boss 16*b* of the frame 2 by the locking bolt 19 along with the diaphragm 21 and the two packing rings 20 and 20'.

However, it is very difficult to precisely array the chamber cover 17, the two packing rings 20 and 20' and the diaphragm 21 with each other or to keep the primarily arrayed positions of them on the frame 2 while assembling them with the frame 2 using the locking bolt 19. Therefore, they may fail to be precisely assembled to each other on the frame 2. The conventional apparatus for noise depreciating for hermetic compressors is thus undesirably reduced in work efficiency while being assembled into a single structure.

DISCLOSURE OF THE INVENTION

Accordingly, the present invention has been made keeping in mind the above problems occurring in the prior art, and an object of the present invention is to provide an apparatus for noise depreciating of highly compressed working fluid in hermetic compressors, which is designed to improve work efficiency while being assembled into a desired single structure.

In order to accomplish the above object, the present invention provides an apparatus for noise depreciating in hermetic compressors, comprising: a muffling chamber adapted for reducing noises of compressed and exhausted working fluid prior to discharging the working fluid from a compressor, a chamber cover adapted for sealing the muffling chamber from the outside of the chamber, a means for dividing the muffling chamber into two or more parts and being integrated with the chamber cover into a single body, and a means for locking the chamber cover to a frame of the compressor so as to allow the chamber cover to seal the muffling chamber.

In the above device, the muffling chamber dividing means is welded to a step formed on the internal surface of the chamber cover. This dividing means also has a dome shape, with an inclined part being formed along the edge of the dome-shaped dividing means so as to allow a process of welding the dividing means to the chamber cover to be easily performed.

In the apparatus for noise depreciating of this invention, the number of parts is preferably reduced, and so it is possible to remarkably improve work efficiency and productivity while assembling such muffling devices.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
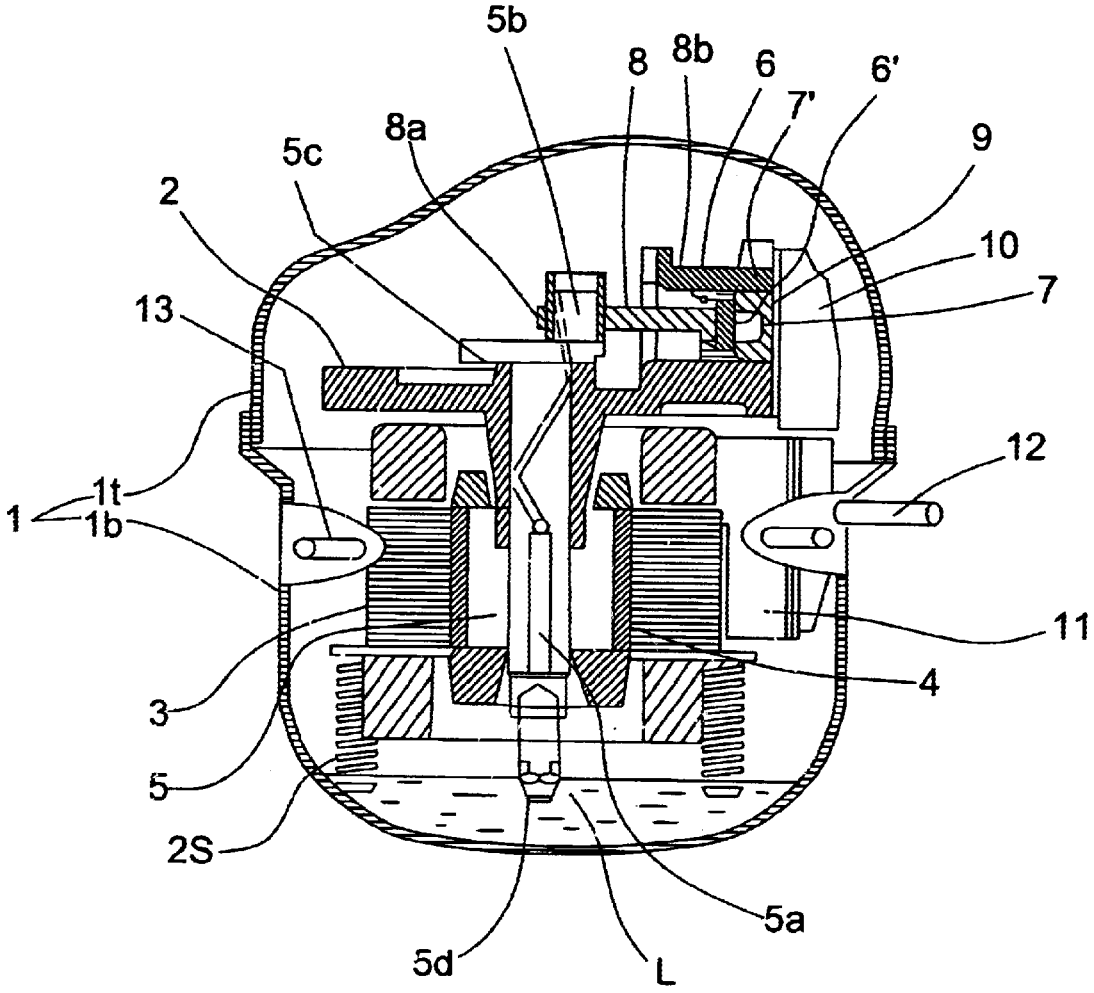
PRIOR ART FIG. 1
FIG. 1 is a sectional view, showing the internal construction of a conventional hermetic compressor.
Figure 2:
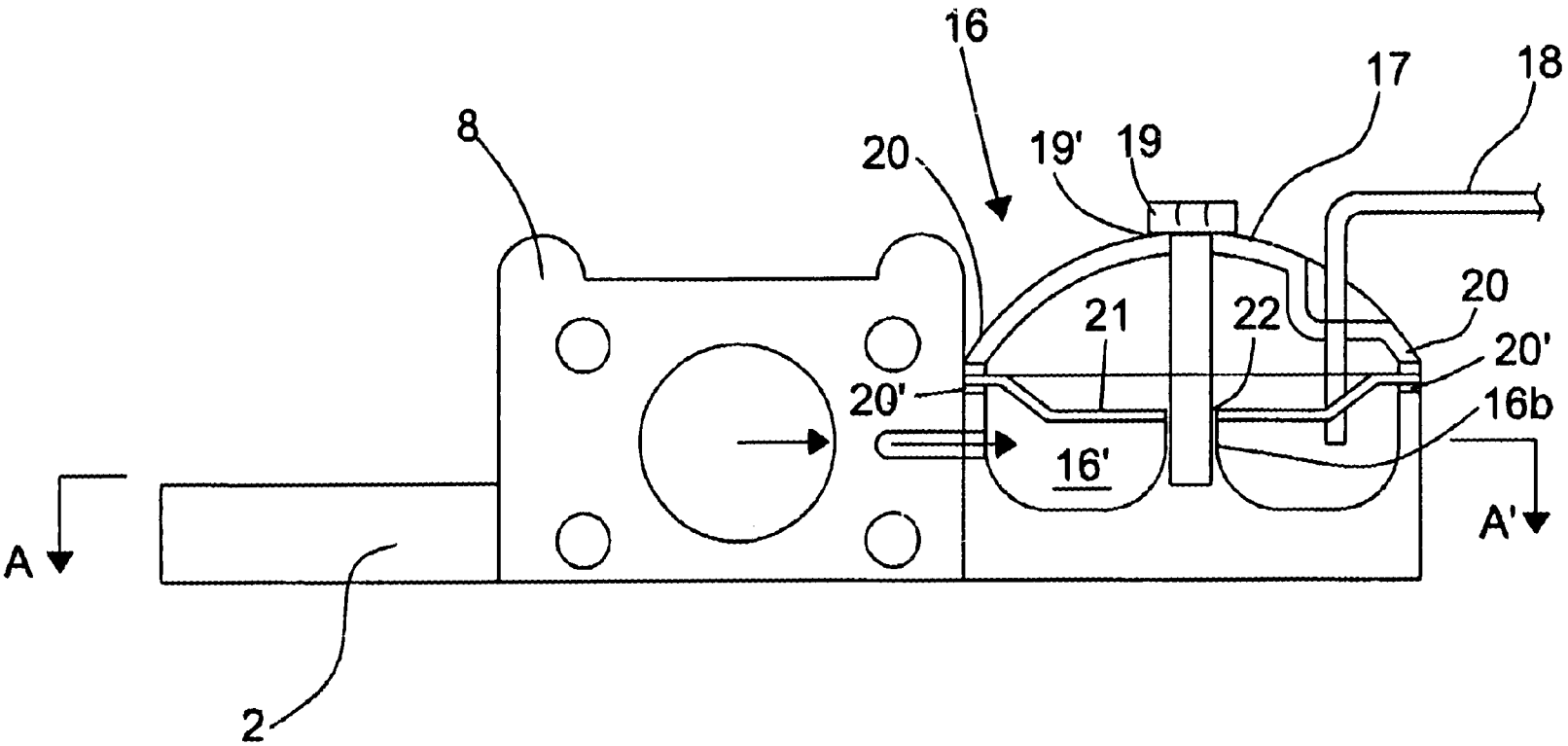
PRIOR ART FIG. 2
FIG. 2 is a front view of the conventional hermetic compressor, showing the construction of a conventional apparatus for noise depreciating of compressed working fluid in the hermetic compressor.
Figure 3:
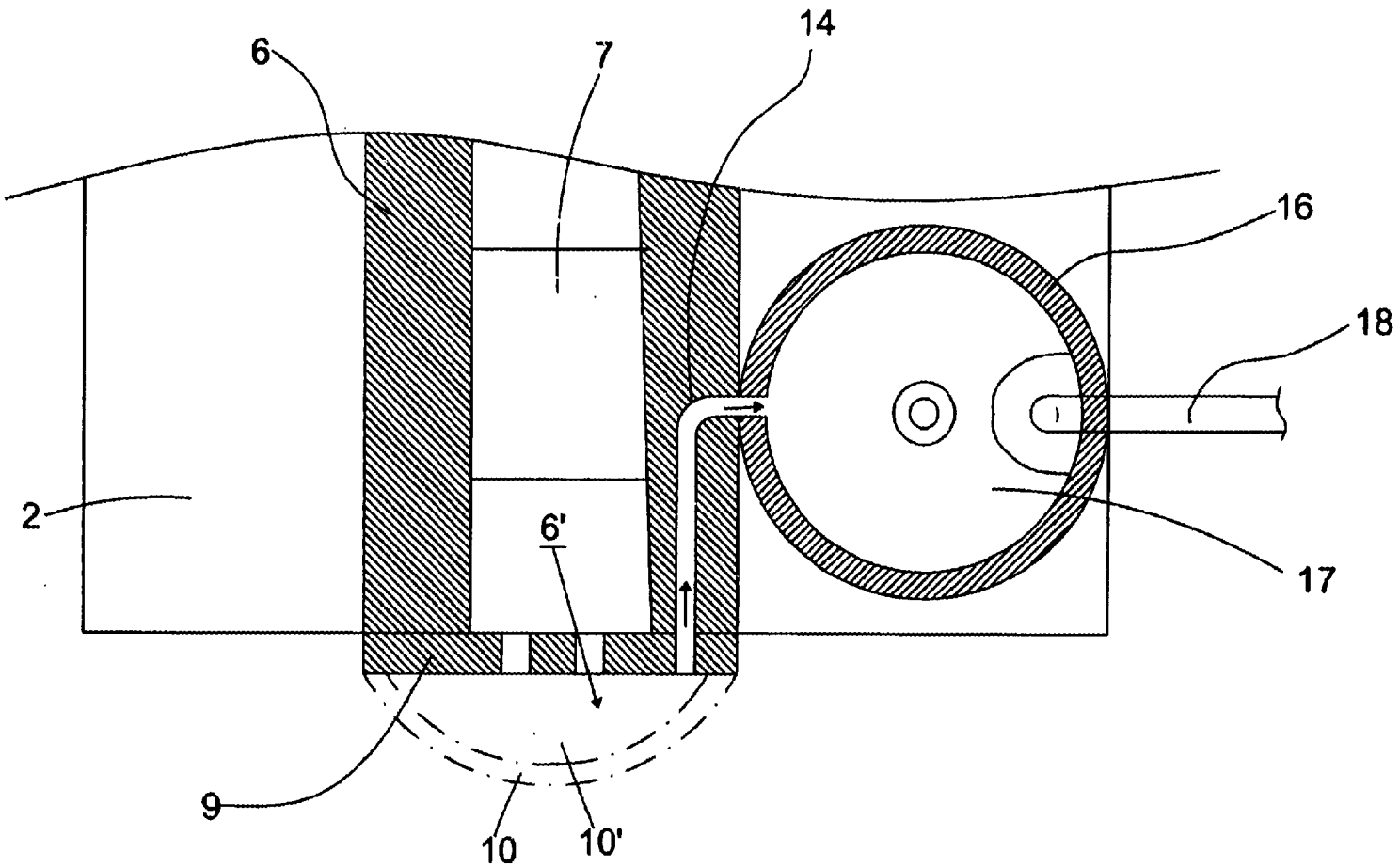
PRIOR ART FIG. 3
FIG. 3 is a sectional view of the conventional apparatus for noise depreciating taken along the line A–A' of FIG. 2.
Figure 4:
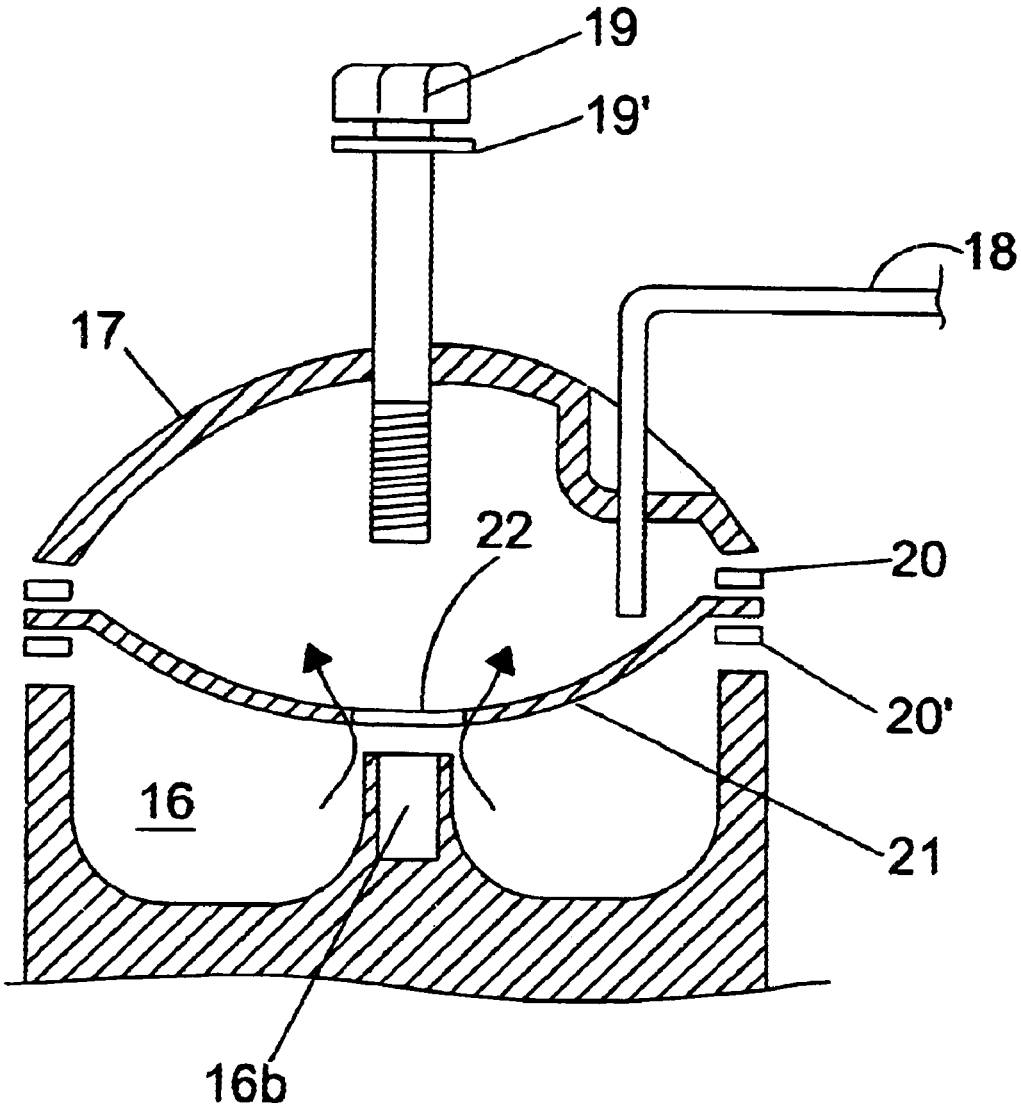
PRIOR ART FIG. 4
FIG. 4 is an exploded sectional view, showing the construction of a muffling unit included in the conventional apparatus for noise depreciating.

Reference now should be made to the drawings, in which the same reference numerals are used throughout the different drawings to designate the same or similar components.

Figure 5:
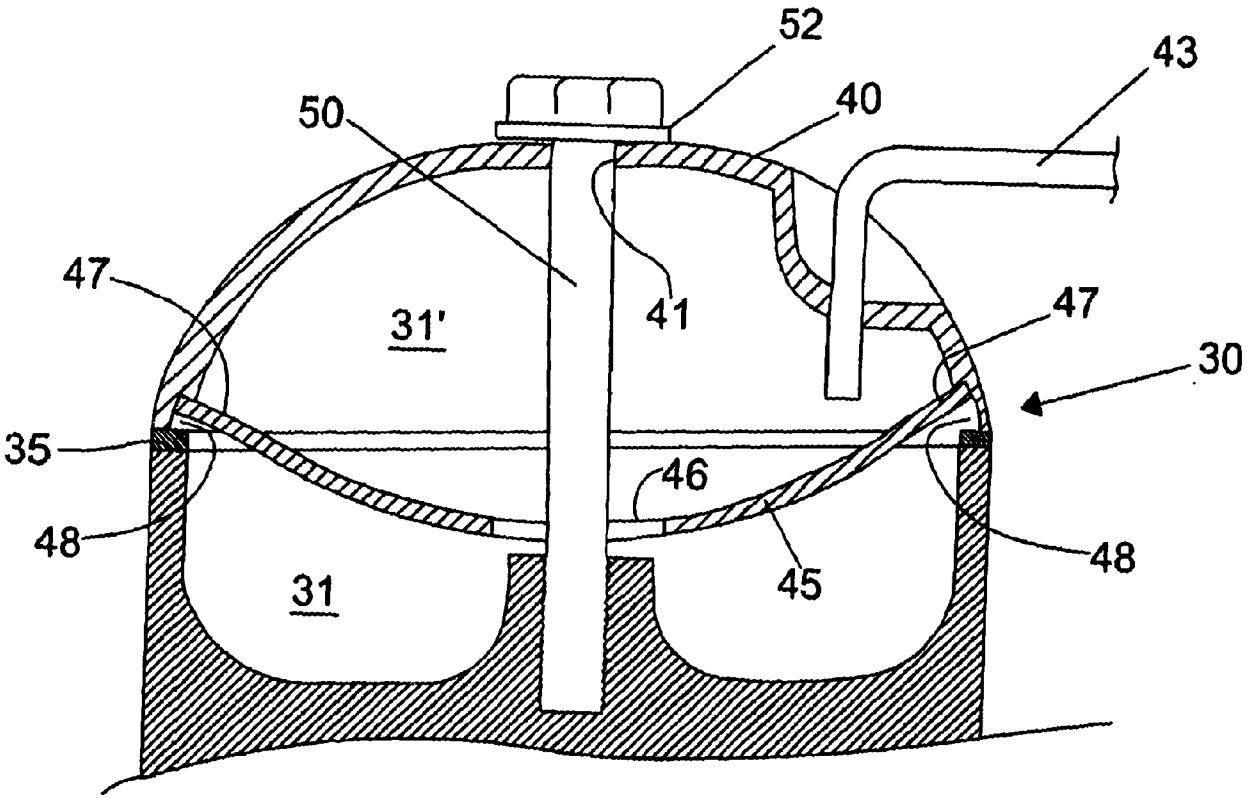
FIG. 5 is a sectional view, showing the construction of an apparatus for noise depreciating of compressed working fluid in hermetic compressors in accordance with the preferred embodiment of the present invention.

FIG. 5 is a sectional view, showing the construction of a device for muffling exhaust operational noises of compressed working fluid in hermetic compressors in accordance with the preferred embodiment of the present invention. As shown in the drawing, the muffling device of this invention has a muffling unit 30 consisting of a muffling chamber 31 formed on a desired position of a frame 2. A chamber cover 40 is mounted to the frame 2 at a position above the muffling chamber 31, thus sealing the chamber 31 from the atmosphere. A locking boss 32 is integrally formed on the bottom of the muffling chamber 31 at the central position.

The chamber cover 40 has a dome shape and is locked to the frame 2 at a position above the muffling chamber 31, with a packing ring 35 being closely interposed between the cover 40 and the frame 2. A hole 41 is formed on the top wall of the chamber cover 40 at a central position and allows a locking bolt 50 to pass through when the cover 40 is mounted to the locking boss 32 of the frame 2 using the locking bolt 50. A loop pipe 43 is installed on the chamber cover 40 and is used for discharging muffled working fluid from the muffling unit 30.

On the other hand, a diaphragm 45 is mounted to the interior surface of the chamber cover 40, thus dividing the muffling chamber 31 of the muffling unit 30 into two parts, or first and second muffling chambers 31 and 31'. The above diaphragm 45 has a dome shape, which is curved in a direction opposite to that of the dome-shaped chamber cover 40. An inclined part 47 is formed along the edge of the diaphragm 45. A hole 46 is formed on the diaphragm 45 at a central position and is used for allowing the two chambers 31 and 31' to communicate with each other through it. That is, the above hole 46 allows compressed working fluid to flow from the chamber 31 into the other chamber 31'. The hole 46 also allows the locking bolt 50 to pass through prior to being tightened to the locking boss of the frame 2 when both the cover 40 and the diaphragm 45 are locked to the frame 2 by the locking bolt 50. In the present invention, the diaphragm 45 is preferably mounted to the interior surface of the chamber cover 40 through a welding process.

The chamber cover 40 is locked to the locking boss 32 of the frame 2 by the locking bolt 50. In addition, a sealing washer 52 is fitted over the shank of the locking bolt 50, thus being closely positioned at the junction between the bolt head and the top center of the chamber cover 40 and sealing said junction when the cover 40 is completely locked to the locking boss 32 by the bolt 50.

Figure 6:
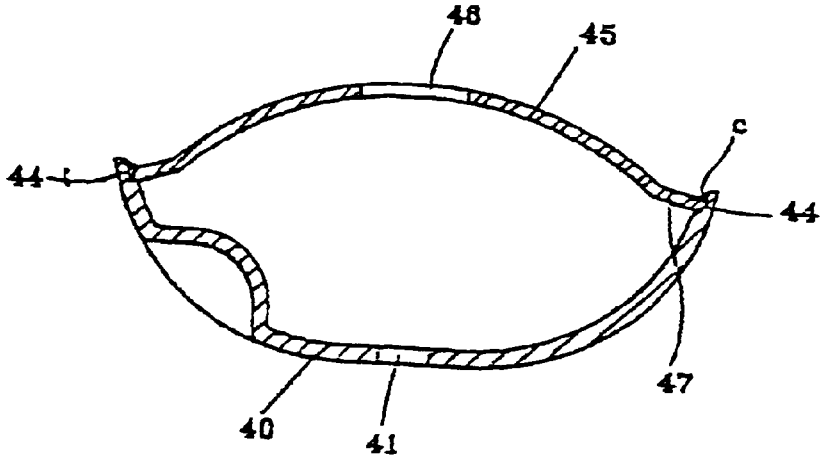
FIG. 6 is a sectional view, showing an assembling of the parts of the apparatus for noise depreciating of this invention into a desired single structure.

The process of mounting the diaphragm 45 to the chamber cover 40 is described herein below with reference to FIG. 6. An annular step 44 is formed along the internal surface of the edge of the chamber cover 40, thus seating the inclined part 47 of the diaphragm 45 thereon.

After setting the parts of the muffling unit at their desired positions as described above, a welding material C is laid along the inclined part 47 of the diaphragm 45 seated on the annular step 44 of the chamber cover 40 prior to starting the welding process. During the welding process, the melted welding material C flows to the step 44 due to the inclination angle of the inclined part 47 of the diaphragm 45, and is hardened so as to form a welded junction 48, at which the edge of the diaphragm 45 is welded to the edge of the chamber cover 40.

The operational effect of the apparatus for noise depreciating for hermetic compressors of this invention will be described herein below.

In an operation of a hermetic compressor, compressed working fluid is discharged from the compression chamber 6' into the first muffling chamber 31, thus being primarily reduced in its exhaust operational noises within the chamber 31. The compressed working fluid is, thereafter, fed from the first muffling chamber 31 into the second muffling chamber 31' through the hole 46 of the diaphragm 45, thus being secondarily reduced in its exhaust operational noises within said chamber 31'. Thereafter, the muffled working fluid is discharged from the muffling unit 30 into the outside of the hermetic housing of the compressor through the loop pipe 43.

The muffling unit 30 of this invention is formed on the frame 2 as follows. That is, the packing ring 35 is laid on the frame 2 at a position around the muffling chamber 31 prior to laying the chamber cover 40 on the frame at a desired position. Thereafter, both the chamber cover 40 and the diaphragm 45 are mounted to the locking boss 32 of the frame 2 by the locking bolt 50 orderly passing through the holes 41 and 46 of both the chamber cover 40 and the diaphragm 45, thus completely forming a desired muffling unit.

As described above, the interior of the muffling unit 30 of this invention is divided into two chambers 31 and 31' by the diaphragm 45, thus allowing the muffling unit 30 to more effectively reduce the exhaust operational noises of compressed working fluid within a hermetic compressor.

In addition, the chamber cover 40 is locked to the frame 2 after the diaphragm 45 is integrated with the cover 40, and so it is possible to easily and firmly assemble the parts of the apparatus for noise depreciating into a desired single structure by simply locking the chamber cover 40, integrated with the diaphragm 45, to the frame 2 at a position around the muffling chamber 31 while interposing only the packing ring 35 between the frame 2 and the cover 40.

Industrial Applicability

As described above, the present invention provides an apparatus for noise depreciating of highly compressed working fluid in hermetic compressors. The apparatus for noise depreciating of this invention is designed to allow a diaphragm, used for dividing the interior of a muffling unit into two muffling chambers, to be supplied to an assembly line while being integrated with a chamber cover, thus remarkably improving work efficiency and productivity while assembling such apparatus for noise depreciating for hermetic compressors.

What is claimed is:

1. An apparatus for noise dampening in a compressor, comprising:

a muffling chamber adapted for reducing noise of compressed working fluid prior to discharging the working fluid from the compressor;

a chamber cover comprising a step formed on an internal surface of said chamber cover, wherein said chamber cover is adapted for sealably enclosing said muffling chamber;

means for dividing said muffling chamber into at least two sections, said means for dividing being welded to said step of said chamber cover; and means for attaching said chamber cover to a frame so as to allow said chamber cover to seal the muffling chamber.

2. The apparatus according to claim 1, wherein said muffling chamber dividing means has a dome shape, with an inclined part being formed along an edge of said dome-shaped dividing means so as to allow a process of welding the dividing means to said chamber cover to be easily performed.

3. A compressor having a cylinder, a piston, and a muffling chamber wherein, the improvement comprises:

a muffling chamber configured to receive a fluid from the cylinder, wherein the muffling chamber comprises:

a receiving chamber;

a chamber cover comprising an annular step; and a diaphragm mounted to the chamber cover, wherein the annular step of the chamber cover is configured to receive a rim of the diaphragm and wherein the diaphragm is mounted at the annular step, and wherein the diaphragm separates the receiving chamber into at least two sections.

4. The compressor of claim 3, wherein the diaphragm is mounted to the chamber cover by a weld.

5. The compressor of claim 3, wherein the diaphragm is mounted to the chamber cover at the annular step.

6. The compressor of claim 3, further comprising a mounting material guide.

7. The compressor of claim 6, wherein the mounting material guide comprises an inclined part of the diaphragm.

8. The compressor of claim 3, wherein the chamber cover is attached to a frame of the compressor to form the receiving chamber, and further comprising a sealing ring that is interposed between the frame and the chamber cover.

9. A compressor having a cylinder, a piston, and a muffling chamber, wherein the improvement comprises:

a muffling chamber configured to receive a fluid from the cylinder, wherein the muffling chamber comprises:

a receiving chamber;

a chamber cover; and a diaphragm wherein the diaphragm comprises a mounting material guide, and wherein the diaphragm separates the receiving chamber into at least two sections.

10. The compressor of claim 9, wherein the diaphragm is mounted to the chamber cover by a weld.

11. The compressor of claim 9, wherein the chamber cover comprises an annular step, and wherein the diaphragm is mounted to the chamber cover at the annular step.

12. The compressor of claim 9, wherein the mounting material guide comprises an inclined part of the diaphragm.

13. The compressor of claim 9, wherein the chamber cover is attached to a frame of the compressor to form the receiving chamber, and further comprising a sealing ring that is interposed between the frame and the chamber cover.

14. A compressor having a cylinder, a piston, and a muffling chamber, wherein the improvement comprises:

a muffling chamber configured to receive a fluid from the cylinder, wherein the muffling chamber comprises:

a receiving chamber;

a chamber cover, wherein the chamber cover is attached to a frame of the compressor to form the receiving chamber;

a sealing ring that is interposed between the frame and the chamber cover; and a diaphragm mounted to the chamber cover, wherein the diaphragm separates the receiving chamber into at least two sections.

15. The compressor of claim 14, wherein the diaphragm is mounted to the chamber cover by a weld.

16. The compressor of claim 14, wherein the chamber cover comprises an annular step, and wherein the diaphragm is mounted to the chamber cover at the annular step.

17. The compressor of claim 14, wherein the diaphragm comprises a mounting material guide, and wherein the mounting material guide comprises an inclined part of the diaphragm.

* * * * *